United States Patent [19]

Kacalieff

[11] Patent Number: 4,611,725

[45] Date of Patent: Sep. 16, 1986

[54] TAMPER EVIDENT BREAKAWAY CLOSURE FOR CONTAINERS

[75] Inventor: Christ D. Kacalieff, St. Louis, Mo.

[73] Assignee: Chris Kaye Plastics Corp., St. Louis, Mo.

[21] Appl. No.: 794,775

[22] Filed: Nov. 4, 1985

[51] Int. Cl.[4] ..... B65D 51/18

[52] U.S. Cl. ..... 220/253; 220/258; 220/266; 222/153; 222/541; 222/516; 222/480

[58] Field of Search ..... 220/265, 266, 258, 253; 222/153, 541, 480, 516

[56] References Cited

U.S. PATENT DOCUMENTS

| | | | |
|---|---|---|---|
| 2,961,133 | 11/1960 | Ankney . | |
| 3,874,580 | 4/1975 | Weatherhead, III | 229/5.5 |
| 3,881,639 | 5/1975 | Herip | 222/153 |
| 3,912,128 | 10/1975 | Ziemann et al. | 222/541 |
| 4,308,979 | 1/1982 | Otterson | 220/253 |
| 4,489,864 | 12/1984 | Davis | 222/541 |
| 4,541,541 | 9/1985 | Hickman et al. | 220/253 |

*Primary Examiner*—George T. Hall

*Attorney, Agent, or Firm*—Gravely, Lieder & Woodruff

[57] ABSTRACT

A tamper evident closure for a container having a plastic base affixed to the container open end and a dispensing controlled rotor carried by the base and so constructed as to make it very evident that tampering may have occurred by the presence of visible damage done to the rotor through forcible tearing or breakage of the rotor.

7 Claims, 8 Drawing Figures

TAMPER EVIDENT BREAKAWAY CLOSURE FOR CONTAINERS

BACKGROUND OF THE INVENTION

1. Field of the Invention

This invention is directed to closure means for containers in which the closure is constructed to breakaway so that tampering with the container or its contents is evident.

2. Description of the Prior Art

The dispensing container art with reclosable closures is generally represented by the combination with an open ended container having a top end closure consisting of a stationary cap forming a base for a rotatable closure disc or rotor. The cap or base is provided with a punch-out tab that closes the dispensing opening until the contents are to be dispensed. The provision of punch-out tabs may take various forms, depending on the character of the contents. The rotor or reclosable disc is operatively attached to the cap or base, and is formed with a blank wall portion which serves to cover the punch-out tab opening when dispensing is not desired. At other times the rotor can be turned to align its preformed aperture or apertures with the base opening. The aperture may be a single hole, a plurality of holes of the same or different diameters, or an enlarged slot or spoon opening. Examples of the foregoing prior art are U.S. Pat. Nos. 3,874,580, 3,881,639, 2,961,113, 3,912,128 and 4,489,864.

The problem with the foregoing examples of the prior art is that none has any way of effectively protecting against tampering with the container tops to contaminate the contents, or of making it visibly evident that the container closure has been tampered with. Tampering is hidden or not made apparent by partially breaking a margin of a punch-out tab or by lifting a rotor to unsnap its center boss to gain access through the boss receiving hole before snapping the cover back in place to conceal the tampering. The foregoing tampering problem has not been overcome in a satisfactory manner as applied to the types of molded plastic caps and rotors now available where a rotor might accidently breakaway and still be capable of concealing tampering.

BRIEF DESCRIPTION OF THE INVENTION

An important object of the present invention is to embody, in dispensing type containers, closures consisting of a stationary base having a dispensing opening and a reclosable rotor so constructed as to make it visibly apparent that tampering has been practiced.

Another object of the present invention is to provide for evidence of tampering with the molded plastic container end closures by forming the reclosable rotors in such a way that attempted tampering will destroy a part of the closure so concealment of the attempted tampering will be prevented.

Other objects of the present invention are to provide a container closure with a breakaway rotor that will make it evident that the container closure has been tampered with, and to provide a closure base and rotor that will snap together on initial assembly but breakaway if removal of the rotor is attempted.

Further objects of the present invention are to make a container closure device of a moldable plastic material that will best serve a wide variety of tamper evident breakaway constructions at an economical cost and to provide a selectivity of rotors so that the closure may serve a range of requirements in which the base can be substantially the same.

BRIEF DESCRIPTION OF THE DRAWINGS

The following drawings illustrate the constructional characteristics of the present tamper evident closures for containers, wherein.

DETAILED DESCRIPTION OF THE EMBODIMENTS

Figure 1:
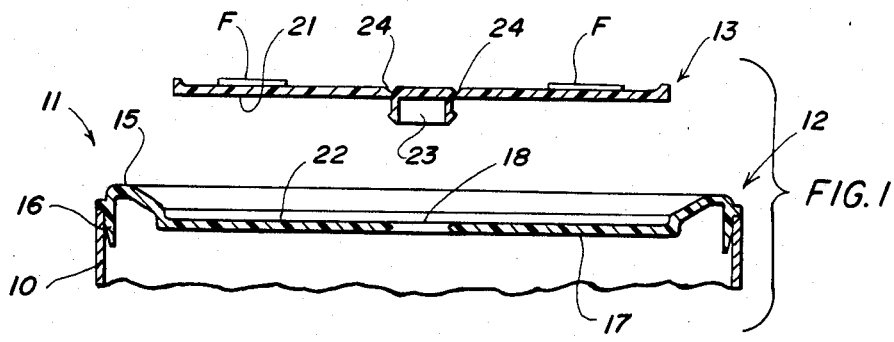
FIG. 1 is cross-sectional view of a closure showing a base and a rotor in an exploded rendering.

The embodiments of this invention relate to closures for containers of fiber material or the like formed into a cylindrical body 10 having a closure at the dispensing end of a character illustrative of the present invention. The closure 11 shown in FIGS. 1 and 2 consists of a molded plastic base 12 and a rotor 13 which may take different forms. The base 12 is formed with a rim 15 having a flange or skirt 16 which is secured in any way to the wall of a container 10. The rim 15 surrounds and frames a recessed wall 17 which is formed with an opening 18. At one side of the opening 18, there is formed a punchout tab 19 which is indicated through a similarly shaped window 20 in the rotor 13. When the tab 19 has been punched out so it hangs by a marginal web (not shown), the contents of the container may be dispensed in the manner to be set out below.

The base 12 carries a disc type rotor 13 which is essentially flat and has a surface 21 presented to ride on the upper surface 22 of the recessed wall 17. The rotor is secured on the base wall 17 by a depending boss 23 of a proper size to fit through the opening or hole 18 in the base wall 17. The boss is long enough to be capable of being upset or formed as is well known with an expanded lip to secure it against being removed or pulled out of the hole 18. In the forming of the boss on the rotor the exterior surface of the rotor is formed with a circular score 24 surrounding the boss 23, which score weakens the rotor base by leaving only a plurality of spaced fins connecting it to the wall. Thus, the score 24 provides a tear-way boss if the rotor is attempted to be removed from the base 12. Any substantial lifting force applied to the rotor 13, in an effort to by-pass the punch-out tab 19, will tear boss 23 and allow the rotor to be lifted off the base. Since the rotor 13 is disposed on the base wall 17 its rim is protected by the raised rim 15 thereby making it difficult to get a prying tool under the rim and also requiring the rotor to be lifted above the base rim 15 which will be sufficient to break the score 24. However, the rotor cannot be replaced because the boss 23 will break away from the rotor 13 and will easily be dislodged and fall into the contents of the container, and the base will be left with an open hole where the rotor boss was. This is clear evidence that tampering has occurred, not only by breaking the rotor away but by leaving an open hole.

Figure 2:
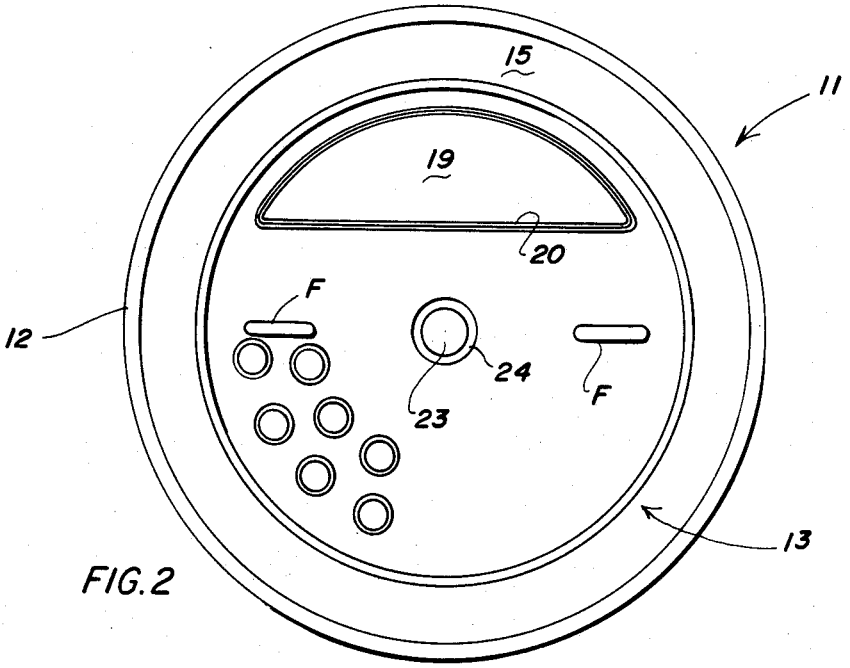
FIG. 2 is a plan view of the closure with the base and rotor in its normal assembled positions with the rotor attached to the base.
Figure 4:
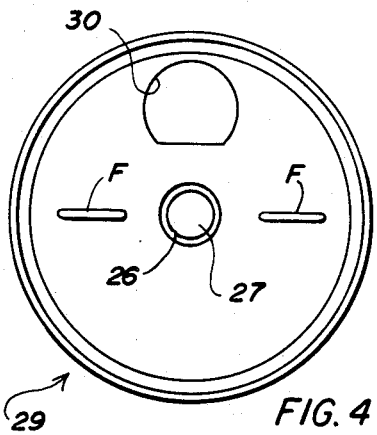
FIG. 4 is a plan view of another alternate rotor.
Figure 3:
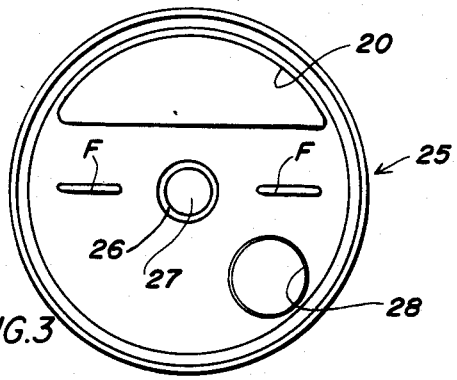
FIG. 3 is a plan view of an alternate rotor.

Turning to FIGS. 3 and 4, there is seen alternate embodiments of the rotor seen in FIG. 2. A rotor 25 is incorporated on a base like the base 12 seen in FIG. 2. The rotor 25 is flat and is formed with a score line 26 which denotes the location of a depending boss 27 which fits the opening 18 in the base 12 and is flanged over to assure it is retained on the base. The embodiment differs from the rotor 13 by providing, in addition to the semi-circular opening 20, a hole 28 which can be positioned to register with the opening when the punch-out tab 19 in the base 12 is displaced inwardly of the container 10. The embodiment seen in FIG. 4 is of a rotor 29 having a single open dispensing hole 30 which can be registered with the opening after the punch-out tab 19 has been displaced. The rotor is provided with boss 27 and score line 26 as in FIG. 3.

Figure 5:
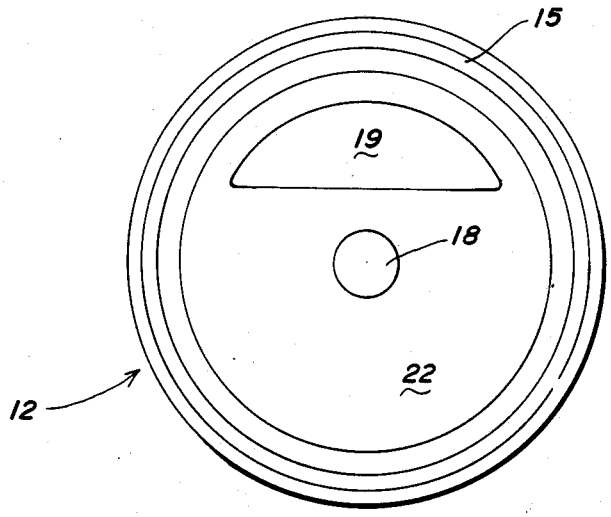
FIG. 5 is a plan view of the base seen in FIG. 2 with the rotor removed as the result of tampering to show the center hole open.

In FIG. 5 it can be seen that the base 12 with the rotor 13 removed is left with an open exposed hole 18, and with the punch-out tab 19 still in place. Thus, a clearly evident tampering effort is indicated.

In addition to the rotor embodiment seen in FIGS. 1 and 2 with a breakaway boss 27, a similar rotor 31 (FIG. 6) may be formed with a non-breakaway boss 32 and in its place a system of score lines 33, 34 and 35 can be made in the underside and so located as to cause the rotor to fracture before the boss 32 can be pulled out of the hole 18 in the base 12. It is seen that a prying instrument must raises the rotor above the protective rim 15 to have any chance of reaching the boss 23. The lifting of the rotor to the extent required to tamper with the contents will cause it to break along any of the score lines 33, 34 or 35, depending on where a prying instrument is positioned.

Figure 6:
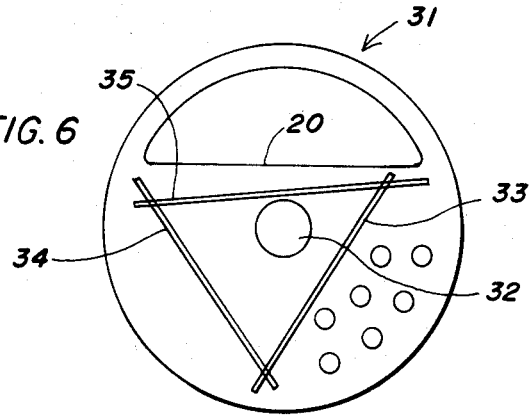
FIG. 6 is a plan view of the underside of the rotor seen in FIG. 1 as modified by breakaway scoring.
Figure 7:
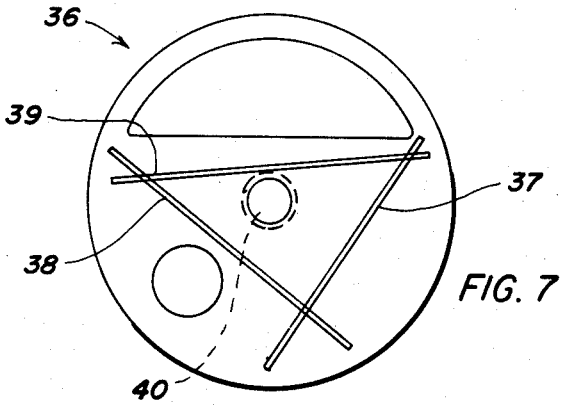
FIG. 7 is a plan view of the underside of the rotor seen in FIG. 3 with breakaway scoring.

FIG. 7 illustrates a system of scoring of a rotor 36 similar to the rotor 25 seen in FIG. 3. In this modification the scoring at 37, 38 and 39 is arranged like it is in FIG. 6 to form a triangle about the boss 40.

Figure 8:
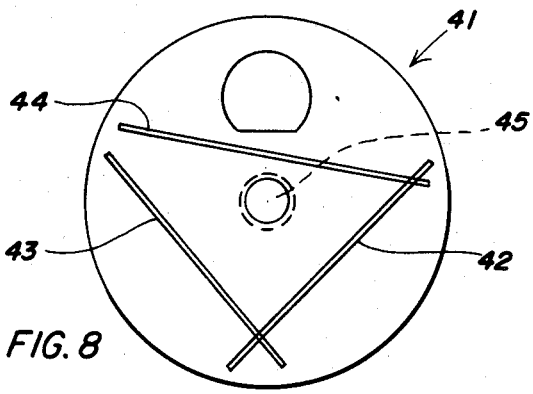
FIG. 8 is a plan view of the underside of the rotor seen in FIG. 4 with breakaway scoring.

The rotor 41 of FIG. 8 is similarly scored at 42, 43 and 44 to surround the mounting boss 45. The intent in each of the scoring systems for the rotors 31, 36 and 41 is to penetrate the material only sufficiently to weaken the rotor without going all the way through, thereby resulting in a break that will be highly visible.

The rotor seen in the closure arrangement of FIGS. 1 and 2, and the modifications seen in FIGS. 3 and 4 is formed of a flexible material such as a low density polyethylene, or an equivalent thereof, which is tough and flexible even at low temperature. When it is intended to have the mounting boss 23 or 27 for rotors 13, 25 and 29 to tear away as the outer perimeter is lifted, a score line 24 or 26 is formed in the under surface to promote tearing so the boss remains behind as the rotor is lifted away from the base.

The rotors of the type disclosed in FIGS. 6 to 8 are intended to be sufficiently brittle to fracture along any one or more of the score lines. Such rotors are made with a polystyrene material which has the desired brittle character. Other materials having a brittleness sufficient to satisfy the present objects may be employed.

In the several rotor modifications it is intended that whatever dispensing opening is used, that opening will register with an underlying punch-out tab in the base. The purchaser of the container may visually see if tampering has occurred by noting the condition of the rotor, or if the rotor is intact the rotor may be turned to provide a visual check on the condition of the punch-out tab in the wall of the base. Rotation of the rotor is easily accomplished by manipulation of raised fins F.

While certain preferred embodiments are disclosure to illustrate the present best mode aspects of the invention, it is to be understood that modifications may come to mind without departing from the intended scope of the invention.

What is claimed is:

1. A tamper evident closure for a container comprising:

(a) a molded plastic base attachable to a container;

(b) a rotor cooperating with said base and exposed to the exterior of the container so as to be in a position to make tampering with the container visually evident;

(c) said base having a rim and a wall recessed below and surrounded by said rim, said recessed wall having a punch-out tab forming a dispensing opening when punched, and a hole in said recessed wall substantially centered to said surrounding rim; and (d) said rotor covering said punch-out tab and hole and having a boss projecting from a first surface of said rotor for secured reception in said hole in said recessed wall, and said rotor having a second surface opposite said first surface exposed to view, said second surface having a score therein opposite said boss for weakening said rotor in the area of said boss to provide for breakage, whereby said boss separates from said rotor in response to tampering with said rotor leaving a visible hole in said rotor.

2. The tamper evident closure set forth in claim 1 wherein said score line is circular, is concentrically aligned with said projecting boss, and penetrates partially into said rotor from said first surface exposed to the exterior of the container.

3. The tamper evident closure set forth in claim 1 wherein said score line is formed in said first surface of said rotor concentrically with said extending boss to form a breakaway connection of said projecting boss with said rotor, and said projecting boss on fracture of said score line being free of said rotor to drop into the container.

4. A tamper evident closure for a container closure comprising:

(a) a molded plastic base for attachment to a container, said base having a peripheral rim surrounding a closure wall recessed below said peripheral rim, said recessed wall having a first surface presented to the container and a second opposite surface exposed to the outside, and also having a punch-out closure in said wall and an aperture opening through said wall between the first and second surfaces of said wall; and (b) a molded rotor having a first surface positionable on said second surface of said base wall, and having a boss projecting therefrom and sized to fit into said base wall aperture for positioning said rotor on said wall, said boss being rotatably secured against said first surface of said base wall for retaining said rotor in position on said base wall, and said rotor having a score formed in its surface opposite said first surface and congruent to said projecting boss to form a line of breakaway weakness between said rotor and said projecting boss, said projecting boss on breaking away from said rotor at said line of breakaway weakness being free to fall into the container and expose a hole in said rotor which is aligned with said aperture in said base, both of said hole and aperture being exposed to view.

5. The tamper evident closure set forth in claim 4 wherein said rotor is molded from flexible low density polyethylene material to breakaway from said base along said score leaving said boss loose in said base aperture and free to fall into the container.

6. A tamper evident closure for a container comprising:

(a) a one-piece base for attachment to a container, said base having a peripheral flange integral with a peripheral rim and a substantially flat central wall surrounded by and recessed below said rim, said central wall having a punch-out tab defining a dispensing opening and a hole in said central wall substantially centered with respect to said peripheral rim; and (b) a rotor having a first surface presented to said central wall, a second surface exposed to the exterior of the closure, and a boss projecting from said first surface for entry into said hole in said central wall to retain said rotor rotatably attached to said base, said rotor also having at least one score line formed in said first surface and directed chordally of said first surface; and (c) said rotor having a periphery positioned adjacent said peripheral rim to restrict entry of a prying instrument under said rotor periphery and force breakage of said rotor along said score line in response to tampering with said rotor.

7. The tamper evident closure set forth in claim 6 wherein said rotor is formed from brittle polystyrene material so as readily to break along said score line leaving the remainder of said rotor attached to said base by said boss.

* * * * *